US005402593A

United States Patent [19]

Lenkarski et al.

[11] Patent Number: 5,402,593

[45] Date of Patent: Apr. 4, 1995

[54] SAFETY TRIGGER FOR A FIREARM

[75] Inventors: Lee M. Lenkarski, Ware; Pardip K. Vaid, Hatfield, both of Mass.

[73] Assignee: Smith & Wesson Corp., Springfield, Mass.

[21] Appl. No.: 200,421

[22] Filed: Feb. 23, 1994

[51] Int. Cl.[6] ..... F41A 17/46

[52] U.S. Cl. ..... 42/70.06; 89/147

[58] Field of Search ..... 42/70.01, 70.04, 70.06; 89/147, 148, 150

[56] References Cited

FOREIGN PATENT DOCUMENTS 2263888 7/1973 Germany ..... 42/70.06

453886 7/1951 Italy ..... 42/70.06

*Primary Examiner*—Stephen C. Bentley

*Attorney, Agent, or Firm*—Chapin, Neal & Dempsey

[57] ABSTRACT

A two-piece safety trigger for a handgun or pistol fabricated from high impact polymer is provided in which a lower portion comprising approximately the entire lower half of the trigger face is pivotable relative to the upper portion. The lower trigger portion includes a rearwardly extending latch portion which, when the lower trigger portion is in its forward position, serves to engage the frame of the gun to prevent firing movement of the trigger in the event the gun is dropped or otherwise impacted. The lower trigger portion is biased to its forward position by a flexible spring finger disposed within the upper portion and is adapted to be overcome when the user squeezes the trigger in a conventional manner.

8 Claims, 3 Drawing Sheets

SAFETY TRIGGER FOR A FIREARM

FIELD OF THE INVENTION

This invention relates to firearms and more particularly to a trigger incorporating a safety mechanism for use on pistols or handguns.

BACKGROUND OF THE INVENTION

One common type of a trigger which incorporates a safety mechanism is used on semi-automatic handguns of the type disclosed in U.S. Pat. Nos. 4,539,889; 4,825,744 and 4,893,546 issued to Gaston Glock (hereinafter, "Glock"). When the trigger of the Glock handgun is actuated, a trigger bar is moved thereby and an abutment engages a nose of a firing pin and moves the same rearwardly until the nose of the firing pin and the abutment have reached a predetermined position. At that position, a firing pin spring will have been compressed and various control or camming means move the abutment out of the path of the firing pin nose whereby the firing pin spring will impel the firing pin with sufficient force to fire a chambered round.

One important aspect of the firing mechanism of the Glock pistol is its use of a spring that assists in the rearward or firing movement of the trigger in lieu of the more conventional type trigger spring that opposes the trigger pull. That spring acts to oppose the force of the main firing pin spring so that the pistol will have a relatively light trigger pull over the major portion of the length of the trigger stroke. A safety feature of Glock pistols is a lever fitted onto the trigger which must be actuated by the trigger finger before the trigger can be moved rearward to fire the weapon. This safety device comprises a thin blade pivotally mounted within a centrally located slot in the trigger which in its "safe" position, protrudes forwardly of the concave trigger face for engagement by the trigger finger and also includes an upper portion disposed between the trigger and the frame. When the trigger is actuated by the trigger finger, the blade will first rotate relative to the trigger to retract both portions into the trigger to dislodge the tipper ridge portion and permit the trigger to move freely within the frame.

While this arrangement may increase the safety of the weapon by preventing the trigger from moving rearward when dropped, many experienced shooters are not comfortable with the non-traditional feel of this construction as compared with that of a conventional trigger having a smoothly curved face. Additionally, the protruding blade may increase the possibility of a gloved trigger finger becoming caught thereon and thereby affecting the operation of the trigger during firing.

It is a principal object of this invention is to provide an improved trigger for a handgun or pistol in which a trigger safety device is incorporated therein to prevent rearward movement of the trigger unless the shooter's finger is first placed on the face thereof.

It is a further object of this invention to provide a safety trigger which overcomes the drawbacks of trigger safety devices heretofore available.

It is an additional object of this invention to provide a safety trigger which can be adapted to handguns of various types and configurations.

A further object of this invention is to provide a safety trigger that is lightweight and relatively inexpensive to manufacture while being reliable in operation.

Another object of this invention is to provide a safety trigger for a handgun that closely resembles the look and feel of a conventional trigger.

Another object of this invention is to provide a safety trigger for a handgun in which operation of the safety feature is less perceptible to the user than prior art devices.

Still another object of the present invention is to provide a safety trigger which is less prone to interfere with the operation of the firearm.

According to this invention, a safety trigger has a curved smooth face formed by the front surfaces of upper and lower hingedly interconnected trigger portions. The lower portion of the trigger includes an integral upwardly and rearwardly extending latch member pivotable in response to movement of the lower portion relative to the tipper portion to alternately engage and disengage the frame to prevent the trigger from being moved rearwardly to fire the weapon. Prior to activation by a user, the lower portion is urged slightly forward relative to the tipper portion to its "ready" or "safe" position by an integral spring finger and is automatically moved rearward relative to the upper portion, against the force of the spring, by the trigger finger during firing movement which serves to disengage the latch and allow the entire trigger to rotate rearward to fire the weapon.

The above and other objects and advantages of this invention will be more readily apparent from a reading of the following description of an exemplary embodiment thereof taken in conjunction with the following drawing.

DETAILED DESCRIPTION OF THE PREFERRED EMBODIMENT

Figure 1:
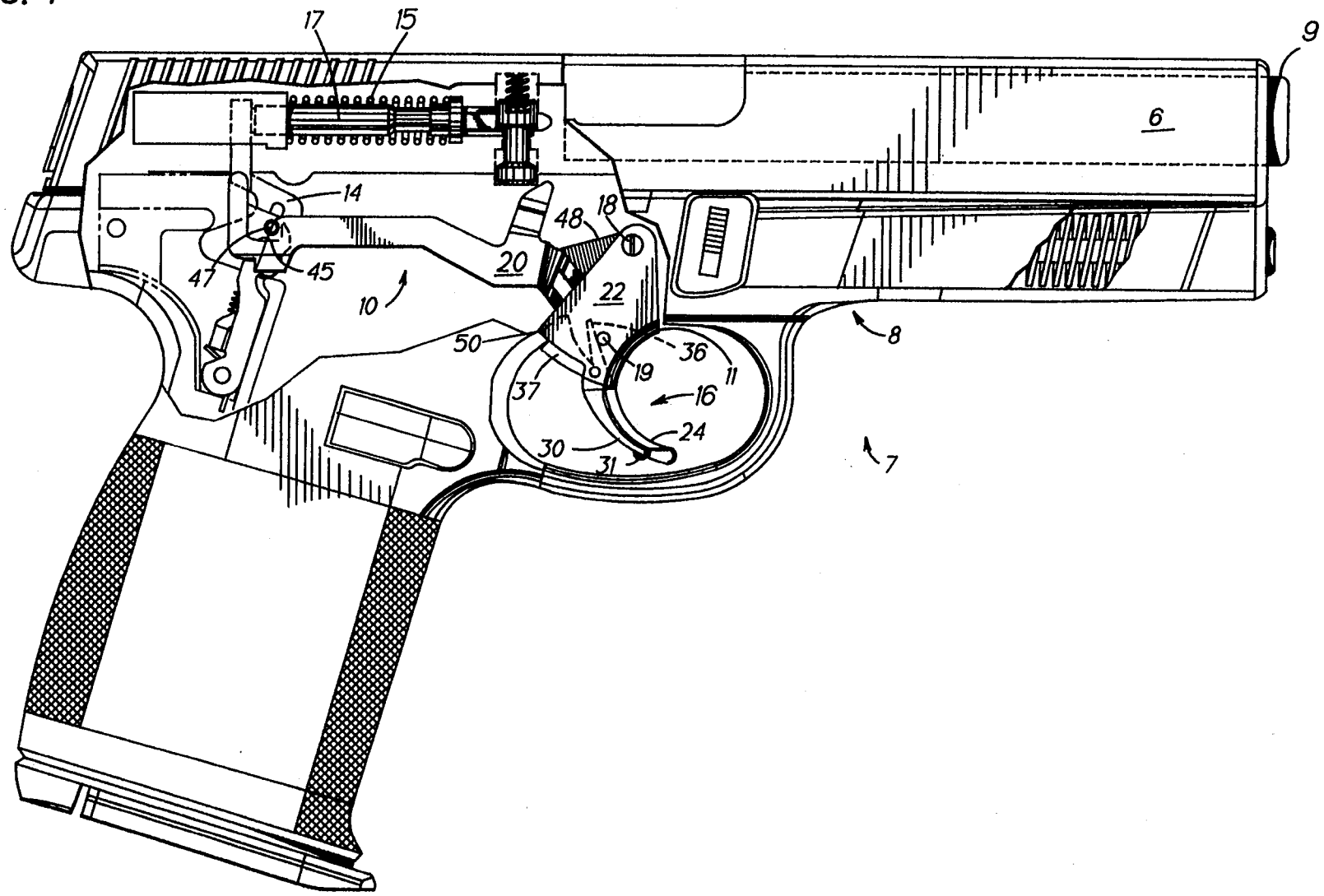
FIG. 1 is an elevational view of a handgun which incorporates the safety trigger of the present invention and in which the safety trigger is in its "safe" position.

Referring to FIG. 1, a handgun 7 incorporating the safety trigger of the present invention includes a slide 6, frame 8, barrel 9 and a fire control mechanism 10. The fire control mechanism 10 generally comprises a trigger 16 that extends through the opening 11 in the frame 8 which pivots to move a trigger bar 20 longitudinally in response to operation of the trigger. When one squeezes the trigger, it will pivot rearward about pivot pin 18 and the pivotable movement will be transmitted to the trigger bar 20 by a pin 19. Movement of the trigger bar 20 will, in turn, move a sear 14 sufficiently to cause compression and then release the firing pin spring 15 to cause the gun 7 to be fired, as described in our co-pending application, Ser. No. 08/168,148 which is hereby incorporated by reference in its entirety.

Figure 3:
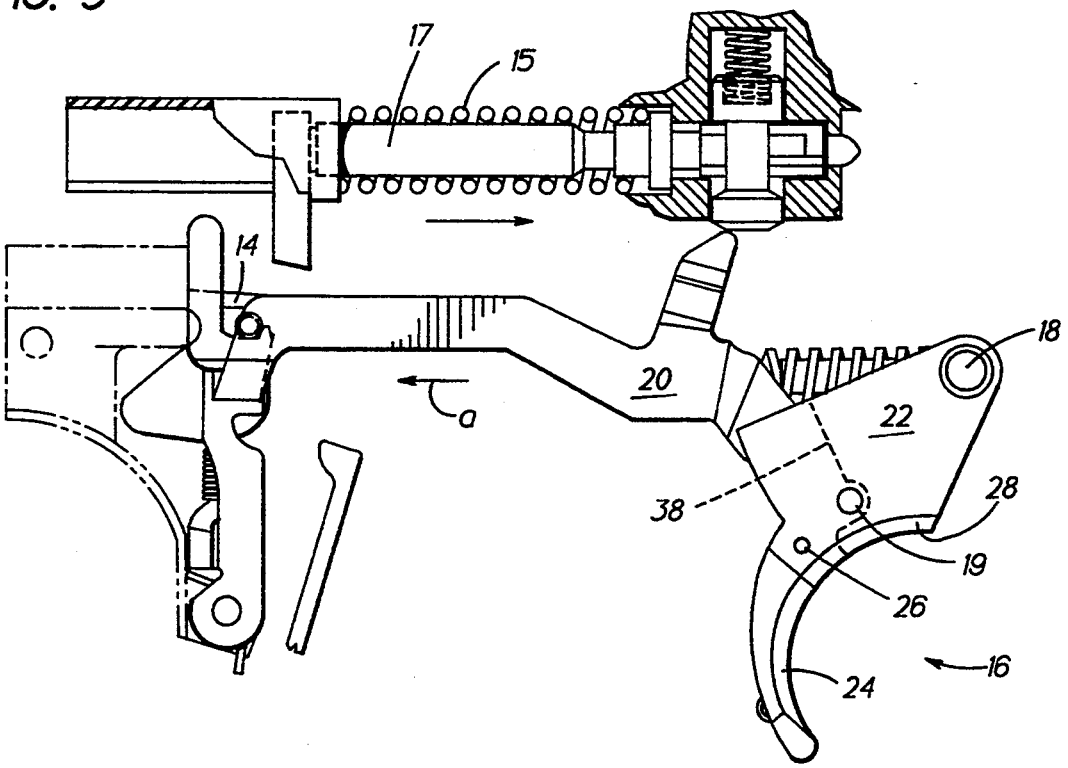
FIG. 3 is a cut-away elevational view of the handgun of FIGS. 1 and 2 in which the trigger has been pivoted rearward to fire a chambered round.
Figure 4:
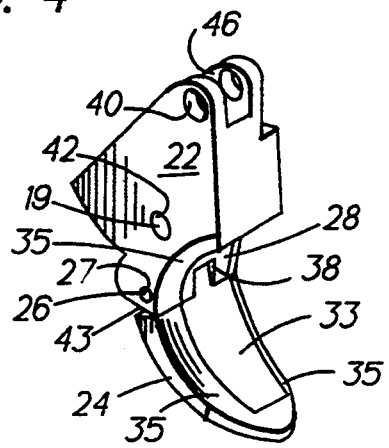
FIG. 4 is a perspective view of the safety trigger of FIGS. 1–3.

The trigger 16 is of articular construction comprising upper and lower portions 22 and 24 respectively, as best shown in FIG. 4 which, are hingedly connected to one another about link pin 26 that passes through bores 27 (FIG. 4) and 29 (FIG. 6) in upper and lower trigger portions 22 and 24, respectively, as will hereinafter be discussed in greater detail. The upper portion has a smooth curved front surface 28 (FIG. 3) and the lower portion has a similarly curved smooth front surface 33. Both surfaces 28 and 33 are preferably chamfered along their longitudinal edges as at 35. Together, these surfaces comprise a smooth, generally continuously curved face of the trigger 16 which provides for a relatively low coefficient of friction with the user's finger. Preferably, each surface 28 and 33 comprises approximately 50 percent (50%) of the face of the trigger.

In the preferred embodiment, the trigger 16 is fabricated of a polymeric material, preferably an acetal such as that sold by DuPont Corp. under the trademark Delrin® P100. It is important that the material used provides a high level of structural integrity while also having inherent lubricity and resilience which ensures smooth and quiet operation with minimal wear of the components and which is adapted to provide a control spring integral therewith. Furthermore, the use of such polymeric material provides for reduced overall weight of the trigger 16 and particularly the lower portion 24 which serves to prevent it from pivoting rearward due to its own moment of inertia, as will hereinafter be discussed.

Figure 6:
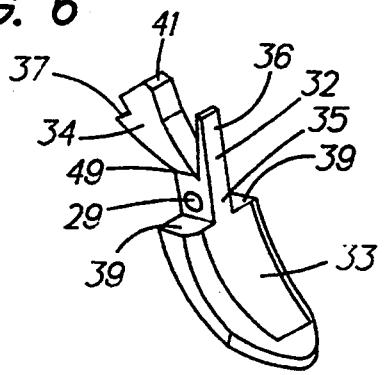
FIG. 6 is a perspective view of the lower trigger portion of FIGS. 1–4.

Referring now to FIGS. 1 and 6, the lower trigger portion 24 includes the concave finger engaging front surface 33 and a rear surface 30 upon which a trigger stop 31 is disposed. A shank or hinge section 51 having a width approximately onethird that of the finger engaging surfaces 28 and 33 is generally centered on upper edge 39 of the lower trigger portion. A bore 29 extends through the shank 51 that provides for pivotable movement of the lower trigger portion 24. Above the bore 29, the shank 51 is bifurcated to form an upwardly extending spring finger 32 and an obliquely extending safety arm 34. The spring finger 32 has a length of approximately 0.300" and is of the same width as the shank 51 and tapers in thickness from between approximately 0.030" and 0.035" at the shank 51 to between approximately 0.020" and 0.025" at its upper or outer end 36. These dimensions together with the material used provide spring-like characteristics with maximum flexibility at the tip of the spring finger 32 with minimal flexing at the lower end thereof to minimize the danger of stress fractures propagating from the V-shaped bifurcation 49. The safety arm 34 includes a notch 37 for latching engagement with the frame 8 and an upper stop surface 41 (FIG. 6).

Figure 5:
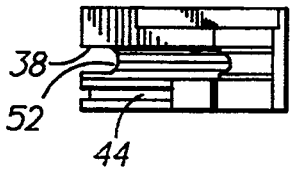
FIG. 5 is a top view of the upper trigger portion of FIGS. 1–4.

The spring finger 32 and the safety arm 34 both extend into a slot or recess 38 (FIGS. 3, 4 and 5) in the upper trigger portion 22, as best shown in FIGS. 4 and 5. Referring back to FIG. 1, the upper end 36 of the spring finger 32 (shown in phantom) rests against pin 19 disposed transversely through a bore 42 (FIG. 4) in the upper trigger portion 22 and serves to bias or urge the lower trigger portion 24 counterclockwise or towards its forwardmost position relative to the upper trigger portion 22.

When in this forwardmost position, the safety arm 34 (FIG. 6) is also urged counterclockwise so that its notch 37 will be engaged to latch with the rear edge 50 of the opening 11 of frame 8 to prevent the rearward movement of trigger 16, as shown in FIG. 1. This obstruction or engagement serves to prevent the trigger 16 from moving rearwardly and unintentionally discharging the firearm in the event that the gun is dropped. As mentioned above, the lightweight polymer used to fabricate the lower portion 24 of the trigger helps to ensure that even if dropped from a great distance, the moment of inertia generated by the lower portion 24 would not itself be sufficient to overcome the bias of the spring finger 32 to allow it to pivot to its rearward position relative to the upper portion 22. Moreover, such light weight allows the spring finger 32 to be configured to exert a relatively light bias on the lower portion whereby it is almost imperceptible and impalpable to the user during firing of the gun 7.

The upper trigger portion also includes a stop seat 52 and a shoulder 43 which both serve to positively prevent further rearward movement of the lower trigger portion relative to the upper portion once the lower portion reaches its rearwardmost position. Accordingly, when in this rearwardmost position, as in FIG. 2, the stop seat 52 (FIG. 5) will be engaged by the upper stop surface 41 (FIG. 6) of the lower trigger portion 24 and the shoulder 43 will be engaged by the upper edge 39 of the lower trigger portion. The lower trigger portion 24 optimally pivots between 15° and 20° from its forwardmost to rearwardmost positions relative to the tipper trigger portion 22.

Figure 2:
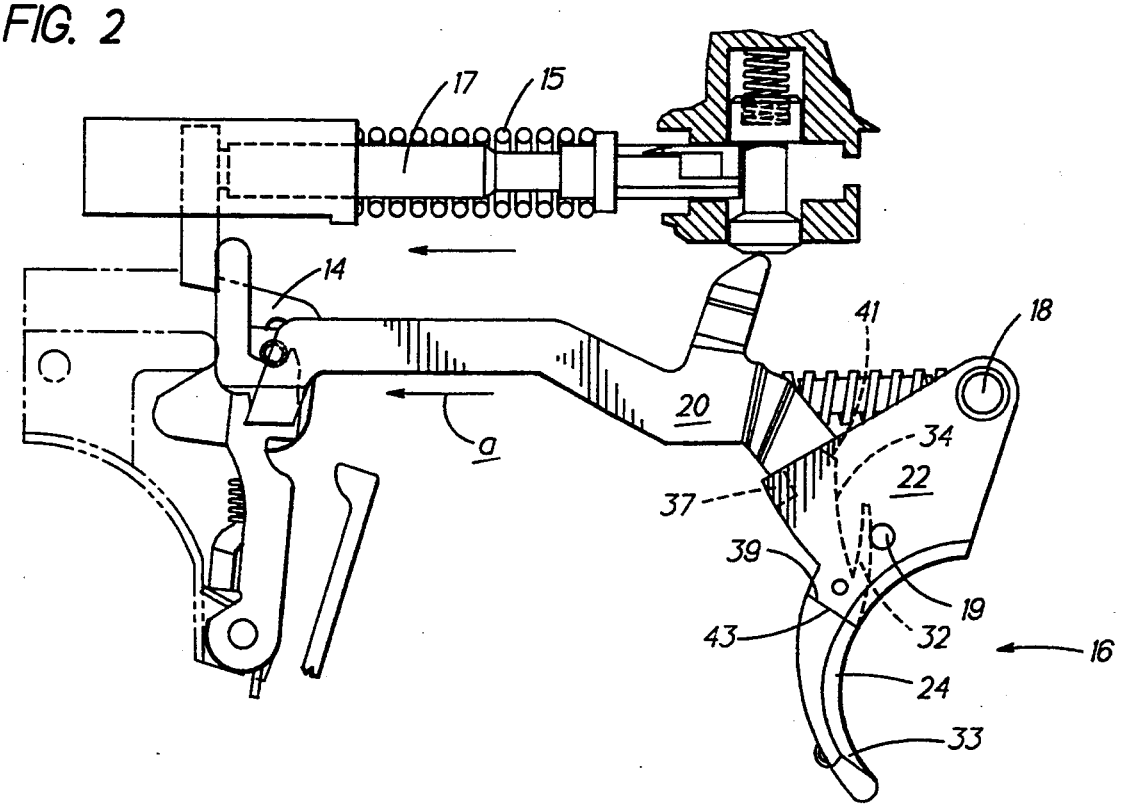
FIG. 2 is a cut-away elevational view of the handgun of FIG. 1 in which the trigger is in its initial stage of actuation with the lower trigger portion thereof rotated rearward relative to the upper trigger portion to release the safety trigger.

As best shown in FIGS. 1–3, the pin 19 also serves to pivotably interconnect one end of the trigger bar 20 to the upper trigger portion 22 whereby the trigger bar 20 extends through a slot 44 in the upper trigger portion 22 (FIG. 5) and the pin 19 passes through a bore (not shown) adjacent the forward end of the trigger bar. The after-end of the trigger bar 20 includes an upwardly opening hook 45 which serves to interengage with a sear pin 47 for moving the sear 14 rearward to cock and then release the firing pin spring 15 and firing pin 17 to fire the gun, as described in our above-referenced co-pending application. The tipper trigger portion 22 is pivotably connected to the frame 8 by the pivot pin 18 which passes through bore 40 of the trigger portion 22 (FIG. 4). The trigger portion 22 (along with trigger bar 20) is urged to its forward position, as shown in FIG. 1 by a coil trigger spring 48 that is secured at one end to a hole provided through a spring mounting arm (not shown) which extends transversely of the trigger bar 20. The other end of the spring 48 is fitted onto the pivot pin 18 of the trigger and passes partially through an upper portion of the slot 38 (FIGS. 3, 4 and 5), as at 46 in FIG. 4.

With regard to the operation of the trigger of this invention, as the trigger is pivoted clockwise about the pivot pin 18, the trigger bar 20 connected to the trigger 16 by pin 19 will move toward the rear of the gun, as illustrated by the arrow a in FIG. 2. This motion will cause spring 48 to expand and thus be tensioned to urge the trigger bar 20 forwardly for return to its forward position after each round is fired.

Referring now to FIG. 2, as the user begins to actuate the firing mechanism 10 by squeezing the trigger 16, the initial movement consists of the lower trigger portion 24 being pivoted toward its rearwardmost position relative to the upper trigger portion 22 against the bias of the spring finger 32. Such pivoting will cause the notch 37 of safety arm 34 (FIG. 6) to be disengaged from the frame 8 and to be retracted into slot 38 of the upper trigger portion 22 whereby firing movement of the trigger will clear the frame 8.

As also shown in FIG. 2, as the user continues to squeeze the trigger, the lower trigger portion 24 remains stationary relative to the upper portion 22 as the entire trigger 16 (upper and lower portions 22 and 24) begins to pivot in a unitary manner rearward about pivot pin 18. The trigger bar 20 will thereby be moved rearward to cock the firing pin spring 15.

As shown in FIG. 3, further rearward movement of the trigger 16 will cause the firing pin spring 15 to be released to fire the gun 7. The trigger stop 31 serves to prevent damage to the trigger 16 in the event the user continues squeeze the trigger after firing the gun 7. In such an event, the trigger stop 31 will move into abutment with the frame 8 to prevent continued rearward movement of the trigger after firing.

Among the advantages of the above described construction is the provision of a trigger which has a smoothly curved face. This provision increases the contact area between the user's finger and the trigger to thereby improve comfort to the user by reducing the amount of force per unit area necessary to be exerted by the user's finger during firing.

In addition, the smooth face with its chamfered edges serves to closely approximate the look and feel of a conventional one-piece trigger. Indeed, as discussed above, the lightweight of the polymer trigger allows for the use of a relatively small bias of the lower trigger portion towards its forward position. Accordingly, the safety trigger of the present invention is unobtrusive in both its appearance and feel to the user, requiring little or no practice or training on the part of the user while it effectively increases the safety of guns so equipped relative to prior art triggers.

Moreover, the provision of a smooth trigger face rather than one which is ridged, as in the prior art, effectively eliminates the possibility of a glove becoming caught on the trigger during handling of the gun to therefore increase the safety of a gun equipped with the present invention.

Although the trigger of this invention is preferably fabricated from a polymer, it should be recognized by one skilled in the art that the components of this invention could be fabricated from any suitable lightweight material, such as an aluminum alloy, or composite material including carbon fiber or Kevlar® and still remain within the scope of this invention.

Furthermore, although preferred dimensions are set forth for the spring finger and hinge member of the trigger of this invention, it should be recognized that the dimensions could be varied to permit a wide range of levels of spring bias and/or for fabrication of the trigger or individual parts thereof from any applicable material and still remain within the scope of this invention.

It should also be recognized by one skilled in the art that the front surfaces of the upper and lower trigger portions may comprise proportions other than fifty percent (50%) respectively, of the front face of the trigger and still remain within the scope of the present invention.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described my invention, what is claimed is:

1. A safety trigger for a handgun or pistol having a firing mechanism, said trigger comprising an upper segment and lower segment and being of articular construction with a pivotable joint interconnecting the segment above said joint to the lower segment below said joint, said trigger being pivotably connected to the handgun by the upper segment, said upper and lower segments of the trigger defining a generally continuous concave surface for engagement by one's trigger finger and being movable as a unitary structure for firing said gun, said trigger including latch means having a "safe" position for preventing the unitary movement of said trigger about its pivotable connection to the handgun and a "fire" position in which said latch means is movable to permit the unitary movement of said trigger to actuate the firing mechanism, said latch means being movable from and to its "safe" and "fire" positions in response to pivotable movement of the lower segment from a "safe" position, canted slightly forward of the continuous concave surface to a "fire" position and means for releasably biasing said lower segment forwardly to its canted position whereby the trigger cannot be actuated to fire the gun unless engaged by the trigger finger so as to move the lower segment rearwardly from its forwardly canted "safe" position to its "fire" position to release the latch mechanism and thereby permit the unitary movement of said trigger.

2. A safety trigger, as set forth in claim 1, in which said latch means is integral with said lower segment and is adapted to be engaged with the frame to prevent movement of the trigger when the latch means is in its "safe" position.

3. A safety trigger, as set forth in claim 2, in which said biasing means is integral with said lower segment.

4. A safety trigger, as set forth in claim 3, being composed of polymeric material having inherent resilience to provide the releasable biasing function of the trigger.

5. A safety trigger, as set forth in claim 4, in which a bifurcated shank extends from said lower segment and which provides for pivotable movement of said lower segment relative to said upper segment.

6. A safety trigger, as set forth in claim 5, and in which a spring finger extends as a cantilever which defines a first branch of said bifurcated shank.

7. A safety trigger, as set forth in claim 6, in which a latch arm extends in divergent relation to the spring finger as a second branch of the bifurcated shank.

8. A safety trigger, as set forth in claim 7, in which said lower segment of the trigger includes a lower portion intermediate the bifurcated shank and the lower segment and through which a pin extends transversely to provide for pivotable movement of said lower segment of the trigger relative to the upper segment thereof.

* * * * *